US007841378B2

(12) United States Patent
Henning

(10) Patent No.: US 7,841,378 B2
(45) Date of Patent: Nov. 30, 2010

(54) BALLASTED WIND SHIELDING SYSTEM AND METHOD

(75) Inventor: William W. Henning, Sarasota, FL (US)

(73) Assignee: Aer-Flo Canvas Products, Inc., Bradenton, FL (US)

( * ) Notice: Subject to any disclaimer, the term of this patent is extended or adjusted under 35 U.S.C. 154(b) by 287 days.

(21) Appl. No.: 11/291,754

(22) Filed: Dec. 1, 2005

(65) Prior Publication Data

US 2007/0125994 A1 Jun. 7, 2007

(51) Int. Cl.
*A47H 23/00* (2006.01)
*E06B 3/00* (2006.01)
*E01F 7/02* (2006.01)

(52) U.S. Cl. ..... 160/327; 160/45; 160/349.1; 160/368.1; 256/12.5

(58) Field of Classification Search ..... 160/327, 160/328, 349.1, 349.2, 354, 368.1, 45, 46, 160/349.11; 256/12.5, 45
See application file for complete search history.

(56) References Cited

U.S. PATENT DOCUMENTS 1,750,118 A 3/1930 Mueller, Jr. et al.
2,765,487 A 10/1956 Foster
3,004,592 A * 10/1961 Norton ..... 160/114
3,089,268 A 5/1963 Frey et al.
3,224,495 A 12/1965 Truesdale
3,480,069 A * 11/1969 Handwerker ..... 160/354
3,609,894 A 10/1971 Miller, III
3,762,110 A 10/1973 Boss, Jr.
3,827,019 A * 7/1974 Serbu ..... 335/285
3,862,876 A 1/1975 Graves
3,966,172 A 6/1976 Garrett
4,186,912 A 2/1980 Byrd, Jr.
4,685,484 A 8/1987 Moneta
4,699,164 A 10/1987 Pilney et al.
4,770,224 A * 9/1988 Dubbelman ..... 160/331
4,881,565 A 11/1989 Turk
4,887,627 A 12/1989 Audet
4,961,454 A * 10/1990 Reilly et al. ..... 160/344
4,969,500 A 11/1990 Makosa
5,033,719 A 7/1991 Cardente
5,038,889 A 8/1991 Jankowski
5,226,464 A 7/1993 Solov
5,271,449 A * 12/1993 Herrick ..... 160/368.1

(Continued)

FOREIGN PATENT DOCUMENTS

GB 2 207 357 A 2/1989

(Continued)

OTHER PUBLICATIONS

Accurate Tennis Windscreens, <www.accuratetennis.com/windscreens.html>.

(Continued)

*Primary Examiner*—Katherine W Mitchell
(74) *Attorney, Agent, or Firm*—Jacox, Meckstroth & Jenkins

(57) ABSTRACT

A system, apparatus and method for shielding an area from wind is shown. The system, apparatus and method comprise at least one or a plurality of windscreens that yield to a wind to facilitate or reducing or eliminating stresses or forces on a fence to which the at least one or a plurality of windscreens are attached.

94 Claims, 12 Drawing Sheets

U.S. PATENT DOCUMENTS

| | | | | | |
|---|---|---|---|---|---|
| 5,358,025 | A | * | 10/1994 | Wood | 160/368.1 |
| 5,427,169 | A | * | 6/1995 | Saulters | 160/368.1 |
| 5,465,458 | A | | 11/1995 | Schlager | |
| 5,572,833 | A | | 11/1996 | Allen | |
| 5,732,935 | A | | 3/1998 | Codario, Jr. | |
| 5,937,883 | A | | 8/1999 | Camara | |
| 5,961,099 | A | | 10/1999 | Thommen, Jr. | |
| 6,050,280 | A | * | 4/2000 | Jeske | 135/117 |
| 6,131,639 | A | * | 10/2000 | McMillen et al. | 160/123 |
| 6,394,528 | B2 | | 5/2002 | Hoenack | |
| 6,550,525 | B1 | * | 4/2003 | Grisolia | 160/349.1 |
| 6,719,276 | B1 | | 4/2004 | Bush | |
| 6,722,416 | B2 | * | 4/2004 | Varley et al. | 160/264 |
| 6,796,359 | B1 | * | 9/2004 | Knutson | 160/156 |
| 6,840,707 | B1 | | 1/2005 | Kulp et al. | |
| 2003/0160225 | A1 | * | 8/2003 | Osipovs | 256/45 |

FOREIGN PATENT DOCUMENTS

| | | | |
|---|---|---|---|
| GB | 2245611 | * | 1/1992 |
| GB | 2 364 073 | | 1/2002 |
| JP | 2003-268734 | | 9/2003 |

OTHER PUBLICATIONS

Shadowbox Style Wood Fence, <www.fenceonline.com/woodshadowboxstyle.html>.

* cited by examiner

BALLASTED WIND SHIELDING SYSTEM AND METHOD

BACKGROUND OF THE INVENTION

1. Field of the Invention

This invention relates to a ballasted system and method for shielding an area from wind, and more particularly, to at least one or a plurality of ballasted windscreens that may be situated on a support or fence to protect an area from wind and to facilitate reducing or eliminating damage that may occur to the windscreens, supports or the fence to which it is attached.

2. Description of the Related Art

In an outdoor environment, windscreens are commonly used to break up gusting winds, to provide an improved background for a better vision of a ball during a sporting event or practice, such as baseball, tennis, softball and the like, and to minimize distraction for players of sports. Windscreens consist of various woven or otherwise assembled fabrics that can allow approximately 10% to 50% of wind to pass through the material. Prior art windscreens are attached to fence material, usually chain link fences, around the entire perimeter on one side of the fence.

It is well known by sport facilities management personnel (particularly for tennis, baseball, softball and soccer) and by chain link fence construction personnel that after the prior art windscreen is installed, the fence or windscreen can experience wind velocities of 50 mph or more. When sustained wind velocities surpass this threshold, damage to either the windscreen or fence, or both, is almost assured. Damage to the windscreen can cost the replacement of the windscreen and labor. Damage to the fence can cost the replacement of the fence due to the non-repairable nature of the steel pipe posts usually used with the chain link fences when they are bent. The cost of labor is high for both the original installation of the windscreen onto the fence and for the replacement of the windscreen and fence.

At the present time, there is no means, system or method available that allows windscreen that is installed on a fence, such as a chain link fence, to survive high wind velocities (such as sustained winds over 50 mph) or to not damage the fence to which the windscreen is attached, other than by removing the windscreen from the fence prior to the high winds, but this is not practical often times because the winds can be unexpected or sudden, or needed labor is not readily available.

At the present time, the installation of the prior art windscreens requires full attachment around the full perimeter of the windscreen. This is a slow, labor intensive and costly task. If a prior art windscreen is blown off the fence, for example, it requires equally costly reattachment. Another problem with the prior art windscreens is that the procurement of a prior art windscreen typically required the taking of very exacting dimensions and measurements of the fence prior to obtaining the windscreen. This is because the prior art is constructed typically in long segments of windscreen material, typically 60 to 120 feet in length, and they were typically exactly fitted to the fences to which they were attached in order to be fully functional. The custom fabrication and measurements required for the prior art windscreens resulted in very slow delivery times after a user placed an order for the windscreen. For example, a typical delivery time would be 4 to 6 weeks after an order is placed during a peak ordering season, such as February through April.

There is, therefore, a need for a high wind tolerant windscreen apparatus, system and method that is easy to deploy and facilitates protecting the fence or windscreen to which it is attached and facilitates preventing damage to the windscreen and the fence.

SUMMARY OF THE INVENTION

It is therefore an object of the invention to provide a system and method for facilitating reducing damage to a windscreen and a fence.

Another object of one embodiment of the invention is to provide a system and method that permits high winds to pass through a fence, without damaging the windscreen or the fence.

Still another object is to provide an improved system and method for installing windscreens.

Another object of another embodiment of the invention is to provide a windscreen that is only attached to the fence at a distance from its top edge.

Yet another object of another embodiment is to provide a system and method that facilitates installing a windscreen and reduces or eliminates the requirements to take exacting dimensions of an area or fence onto which the windscreen is attached.

Yet another object of another embodiment is to provide a system and method including at least one windscreen that would yield to a wind of predetermined velocity, thereby facilitating reducing the forces and stresses on a fence.

Another object of the invention is to provide windscreen having a ballast or weight, with such weight being permanent or variable.

In one aspect, one embodiment relates to a wind shielding system for mounting on a fence having a first side and a second side, the wind shielding system comprising a first flexible sheet material having a first ballast comprising a first predetermined weight, and a second flexible sheet material having a second ballast comprising a second predetermined weight, the first and second flexible sheet material being arranged on the fence in a predetermined order to facilitate protecting an outdoor area from wind.

In another aspect, another embodiment relates to a windscreen for mounting onto a fence, the windscreen comprising: a flexible sheet material, and a ballast associated with the flexible sheet material for permitting the flexible sheet material to yield to an oncoming wind when the oncoming wind exceeds a predetermined velocity.

In yet another aspect, this invention relates to a method for reducing forces on a fence surrounding a fenced area that is desired to be at least partially protected from wind, the method comprising the step of: providing a plurality of windscreens for situating in a predetermined order on the fence, wherein the predetermined order is such that a first one of the plurality of windscreens is located on a first side of the fence and a second one of the plurality of windscreens is located on a second side of the fence. Other ones of said plurality of windscreens may repeat the order alternating on the first and second sides of the fence.

In still another aspect, this invention relates to a method for screening an area from wind, the method comprising the steps of: fastening a windscreen on the fence such that the windscreen yields leeward away from the fence.

In yet another aspect, this invention relates to a system for screening an area from winds comprising a plurality of windscreens, at least one support on which the plurality of windscreens may be mounted such that at least one of the plurality of windscreens yields to a wind while others of the plurality of windscreens do not.

Another object is to provide a windscreen system and method that have one or more of the aforementioned features alone or in combination with one or more of the other features.

These and other objects and advantages of the invention will be apparent from the following description, the accompanying drawing and the appended claims.

BRIEF DESCRIPTION OF ACCOMPANYING DRAWING

DETAILED DESCRIPTION OF PREFERRED EMBODIMENT

Referring now to FIGS. 1-24, a wind shielding apparatus, system 10, and method will now be described. In one embodiment, the wind shielding system 10 and method facilitates reducing wind forces and stresses on a fence 12 surrounding a sporting or fenced area 14 (such as tennis, baseball, basketball, soccer, and the like) that is desired to be at least partially or fully protected from wind W.

Figure 1:
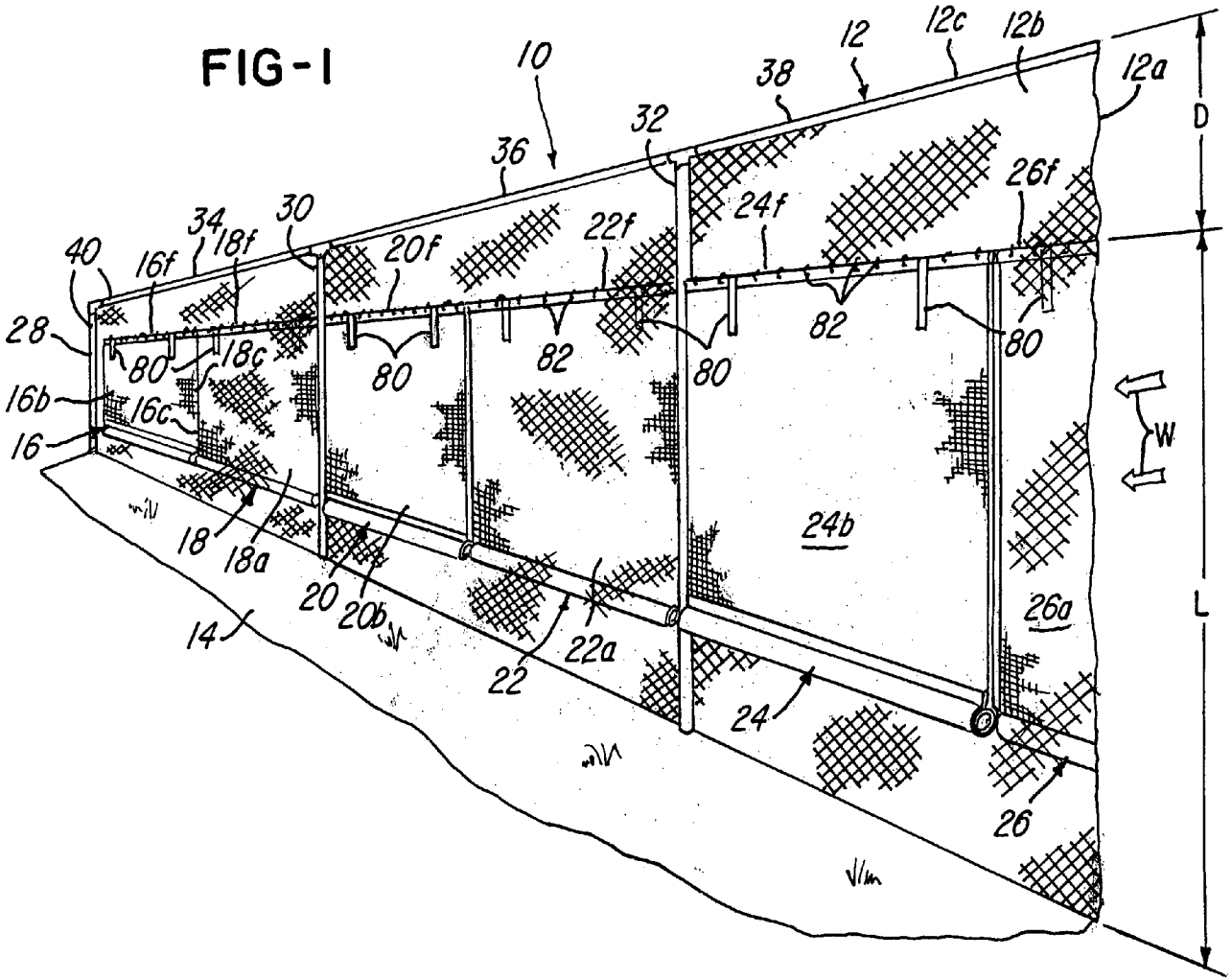
FIG. 1 is a perspective view of a windscreen apparatus and system according to one embodiment of the invention.

In one embodiment, the wind shielding system 10 comprises at least one or a plurality of flexible sheet materials, windscreens or sheets, such as the first flexible sheet or windscreen 16, second flexible sheet or windscreen 18, third flexible sheet or windscreen 20, fourth flexible sheet or windscreen 22, fifth flexible sheet or windscreen 24, and sixth flexible sheet or windscreen 26. For ease of discussion, each flexible sheet material or windscreen will be referred to as a windscreen. Although the illustration is being described with reference to six windscreens 16-26, it should be understood that the system 10 could comprise one or N number of flexible sheet materials or windscreens. Thus, it should be understood that although the embodiment shown in FIG. 1 illustrates the wind shield system 10 comprising six flexible sheets, the invention is not limited to that number of sheets and more or fewer sheets could be used or even a single sheet may be used depending upon the application or environment in which the invention is being used. For ease of description, the system 10 will be described relative to the example embodiment shown in FIG. 1, but it should be understood that more or fewer windscreens N may be used.

Advantageously, the system 10 and method described herein provides a high wind tolerant windscreen system 10 that allows wind traveling at a predetermined velocity to pass through the fence 12 or a portion of a fence 12 without damaging either the windscreens 16-26 or the fence 12.

Figure 2:
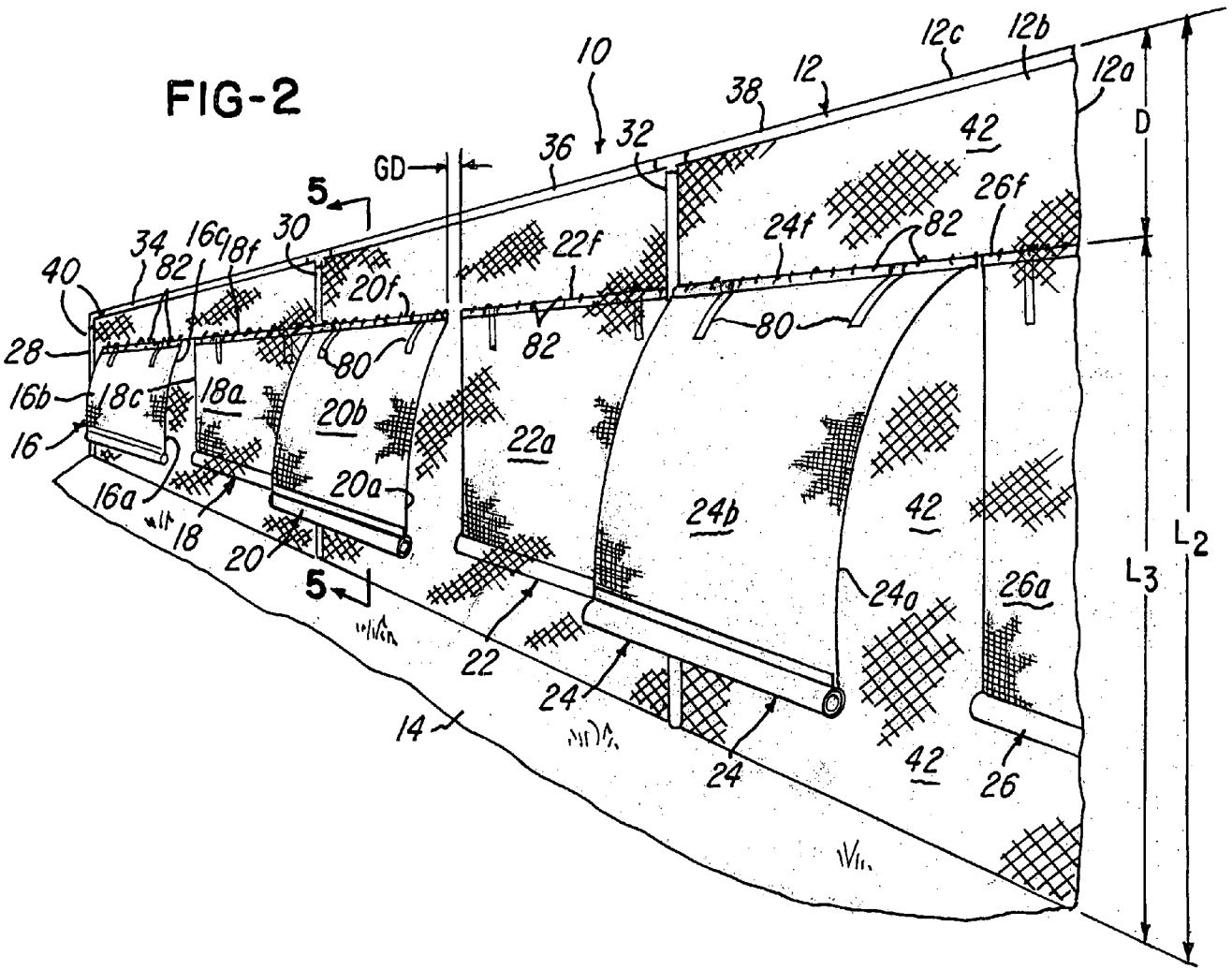
FIG. 2 is another perspective view of a windscreen system apparatus and method, illustrating a plurality of the windscreens yielding leeward or downwind in response to a wind.

In the illustration shown in FIGS. 1 and 2, the fence 12 is a chain-link fence, but the system 10 may be used on other types of fences (not shown), or any wire fence. Note that the fence 12 is supported by a plurality of vertical posts or supports 28, 30, and 32 and horizontal supports 34, 36, and 38 that cooperate to define a frame 40 for holding or supporting the chain link fence as shown. The posts 28, 20 and 32 are typically spaced about 10 feet apart. In the embodiment being illustrated in FIGS. 1 and 2, the size and shape of the vertical posts or supports 28, 30 and 32 and horizontal supports 34, 36 and 38 may vary depending on a size of the fence, height, typical wind forces and the like. Although not shown, it should be understood that the system 10 and method may be used with other types of fences and the fence 12 that does not have to use the horizontal supports 34, 36 and 38 between the vertical posts or supports 28, 30 and 32.

Note that the windscreens 16-26 are arranged in a predetermined order, configuration or position on at least one of a first side 12*a* or a second side 12*b* of the fence 12. The windscreens 16-26 are arranged in the predetermined order on the fence 12 to facilitate protecting the area 14 from wind W. In the illustrations shown in FIGS. 1 and 2, for example, the predetermined order comprises a staggered configuration, with the windscreens 18, 22 and 26 placed on side 12*a* and windscreens 16, 20 and 24 placed or mounted on side 12*b* of the fence 12. In this particular example, every other windscreen is placed on an opposite side 12*a* or 12*b* of fence 12.

It should be understood that the predetermined order or arrangement of the windscreens 16-26 is based upon various factors, including but not limited to, the common or typical direction of the wind, typical wind velocity, gusting wind velocity, size or strength of supports 28-38, height of fence 12, surrounding terrain, buildings and obstacles, landscaping, fence location or other factors that may influence wind direction toward or away from the fence 12 and the like. Returning to the illustration in FIGS. 1-2, note that the windscreens

Figure 5:
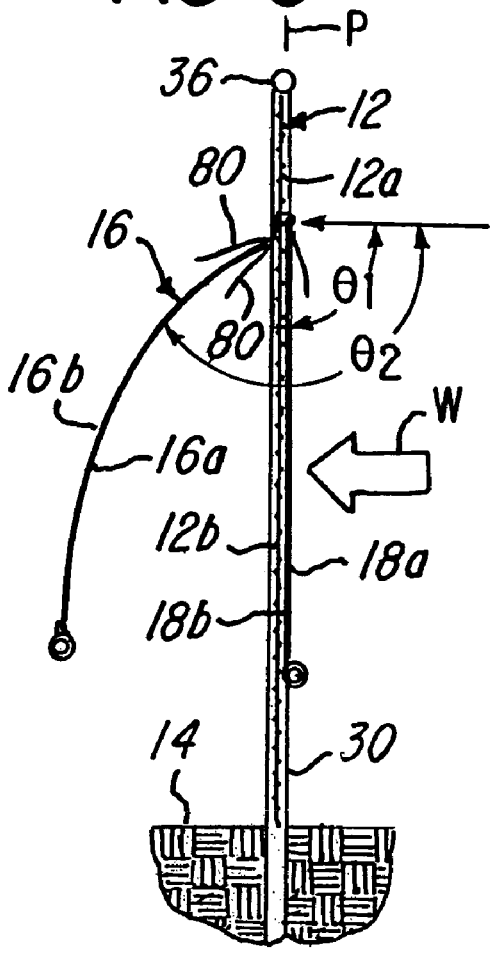
FIG. 5 is a vertical cross-section taken along the line 5-5 in FIG. 2 illustrating a causing of one of the windscreens to yield.
Figure 6:
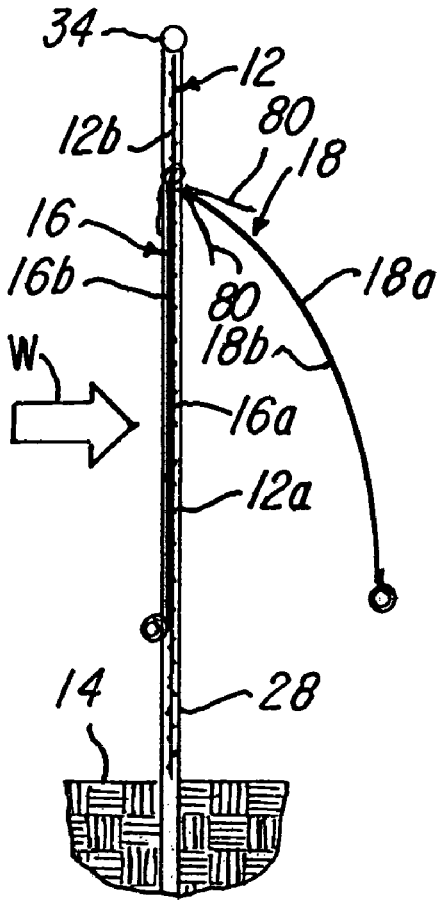
FIG. 6 is a view similar to FIG. 5 illustrating the wind coming from the opposite direction of that shown in FIG. 5 and illustrating another windscreen moving in a leeward or opposite direction of that shown in FIG. 5.

16-26 are arranged in a staggered configuration such that windscreens 18, 22, and 26 are arranged on the first side 12*a* of the fence 12 and windscreens 16, 20, and 24 are arranged on the opposite or second side of 12*b* of the fence 12. When the wind approaches the fence 12 from the first side 12*a* (that is, from the right as viewed in FIGS. 1 and 5), the windscreens 16, 20 and 24 yield leeward or downwind as illustrated in FIG. 5. When the wind velocity comes from the opposite direction or side 12*a*, as illustrated in FIG. 6, then the windscreens 18, 22 and 26 yield leeward or downwind when the wind exceeds the predetermined velocity.

Figure 16:
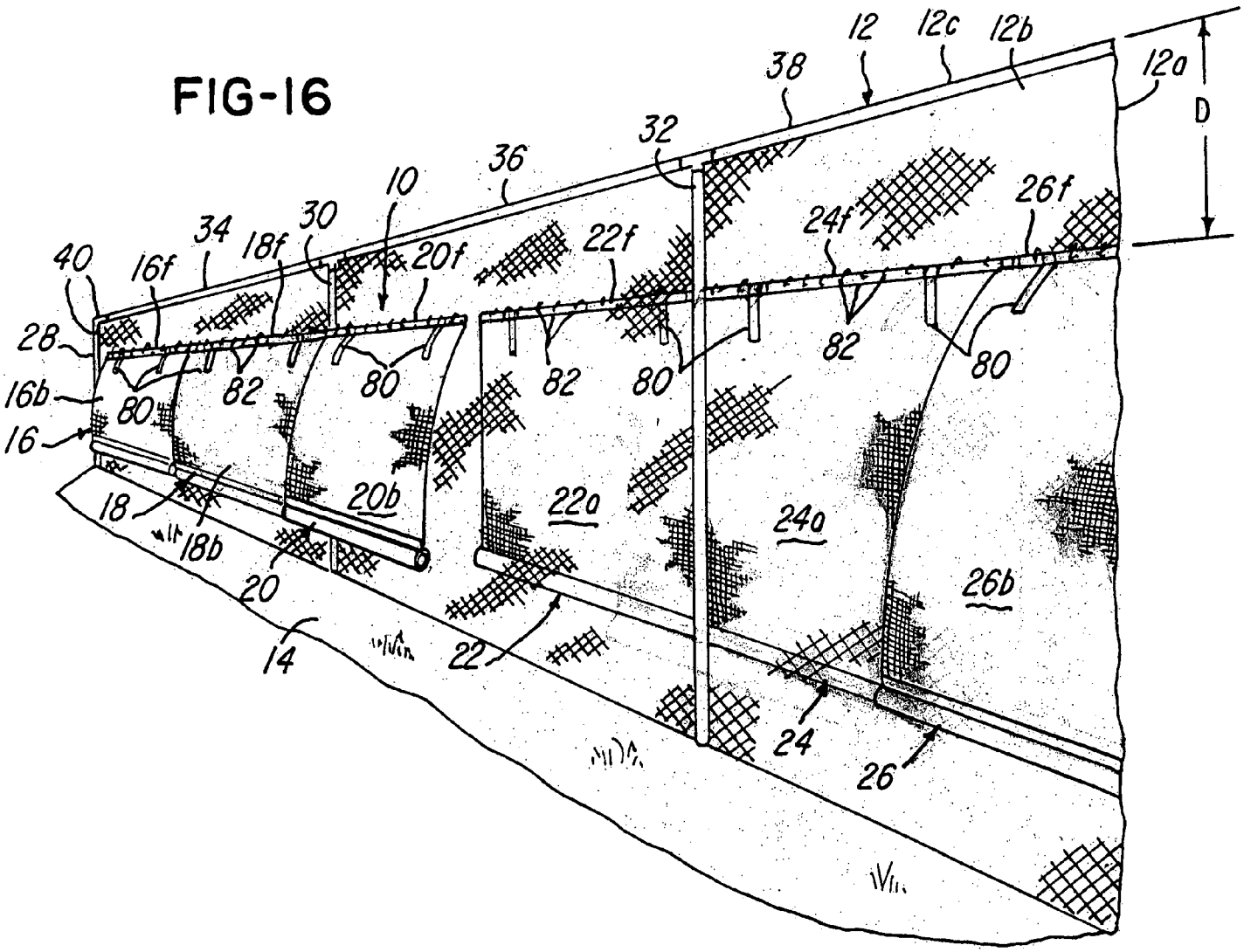
FIG. 16 is a view illustrating the plurality of windscreens in a predetermined configuration which is different from that shown FIGS. 1-4.
Figure 17:
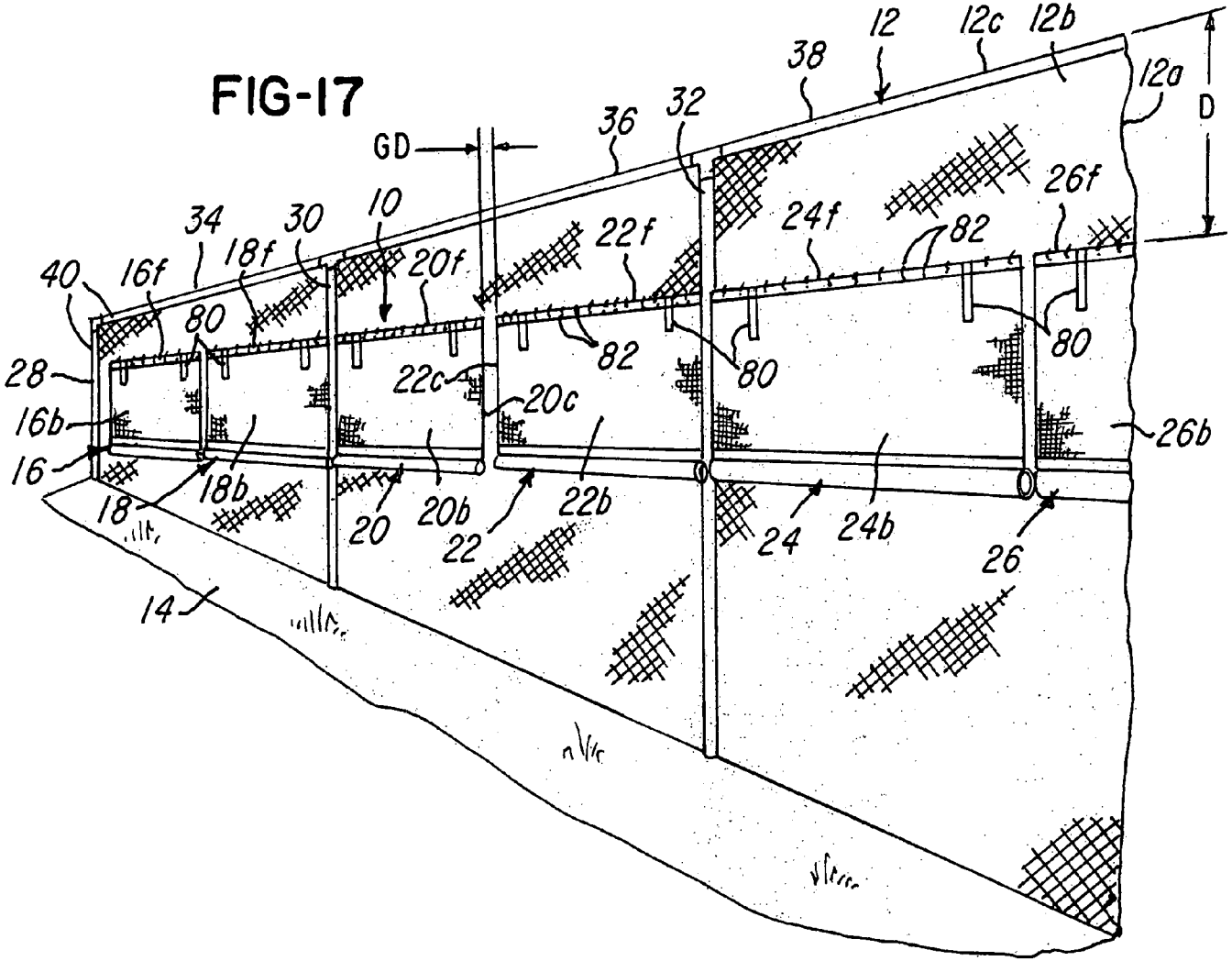
FIG. 17 is a view showing a plurality of windscreens on a common side of a fence and also illustrating a gap distance between adjacent windscreens.

It should be understood that at least one or a plurality of windscreens, such as 16-26, do not have to be located in the staggered configuration illustrated in FIGS. 1-4, but could be located in any configuration or order depending on the environment in which they are used. For example, FIG. 16 illustrates an embodiment wherein the windscreens 16-20 are arranged adjacently and on the side 12*b* of the fence 12 and at a common distance D (FIGS. 1 and 16) from a top 12*c* of the fence 12. The next two windscreens 22 and 24 are arranged on the first side 12*a* of fence 12, and the sixth screen 26 arranged again on the second side 12*b*. FIG. 17 illustrates yet another embodiment wherein in all of the windscreens 16-26 are arranged on a common side, such as second side 12*b*. Thus, it should be understood that the predetermined order or configuration can change as desired in response to the environment and wind conditions in which the system 10 is used.

The entire chain link fence 12 does not have to be covered with windscreens. In a preferred embodiment, less than 100%, but greater than 50% of the entire surface area 42 (FIG. 2) of the fence 12 or a section of the fence 12, such as the section 12*d* (FIG. 3) between posts or supports 30 and 32, may be covered with one or more of the windscreens, such as windscreens 20 and 22, as shown.

Accordingly, it is important to understand that the predetermined order, number, arrangement and selection of the windscreens or sheet material will vary depending on the environment in which the system 10 is used and on such factors including the size of the fence 12 and its components, the predominate wind direction, mounting height, area of fence 12 covered, wind velocity, wind direction relative to the fence 12, and the like. For example, for a tennis court located next to a beach where a predominate wind is typically inland, it may be desirable to situate a majority of the plurality of windscreens 16-26 on the downwind or leeward side (side 12*b* in FIG. 2, for example) of the fence 12, with a predetermined gap distance GD (FIG. 17) between one or more of them, both of which facilitates reducing stress on the fence 12.

Referring now to FIGS. 5-15, various features of the windscreens 16-26 will be described and shown. For ease of discussion, the features will be described relative to windscreen 16, but it should be understood that each of these windscreens 16-26 comprise the same or substantially similar parts.

Figure 7:
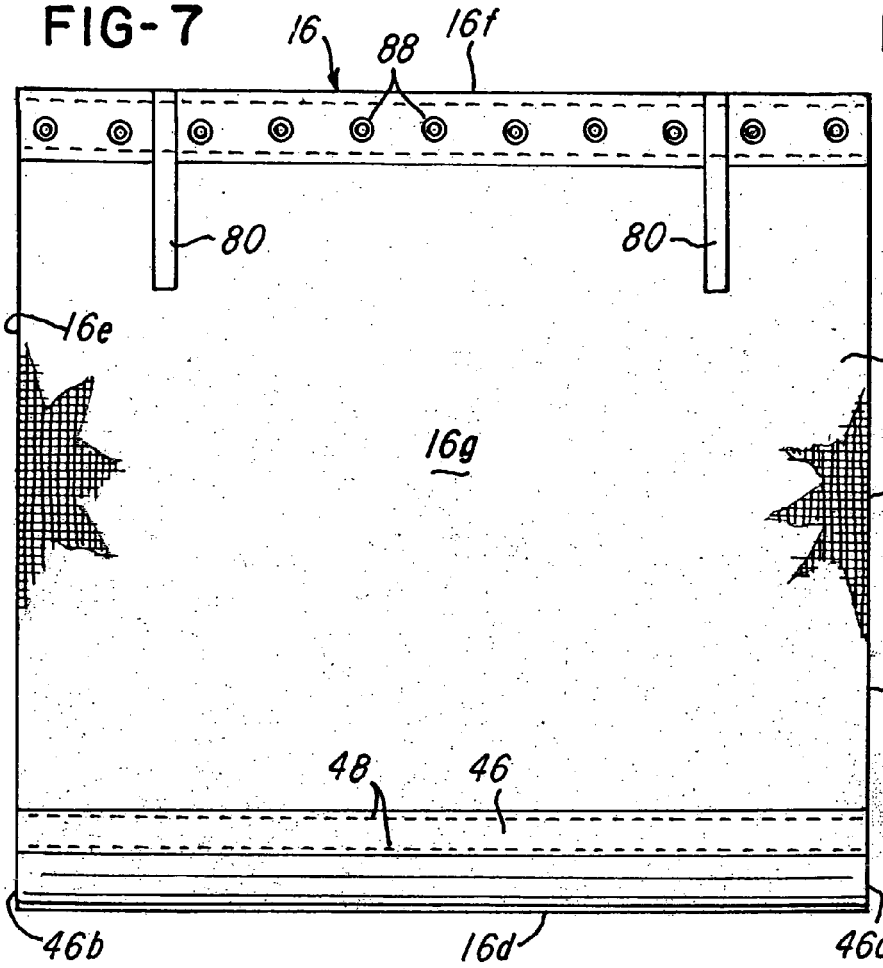
FIG. 7 is a front view of a windscreen in accordance with one embodiment of the invention illustrating various features of the embodiment shown in FIG. 9.
Figure 8:
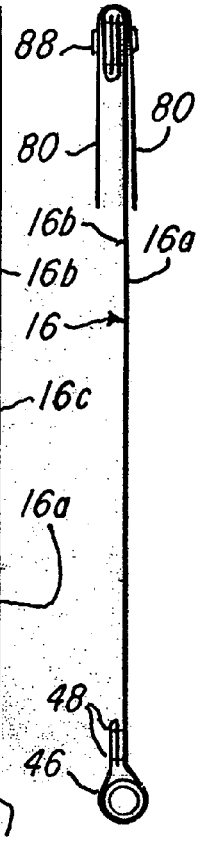
FIG. 8 is a side view of the windscreen shown in FIG. 7.
Figure 13:
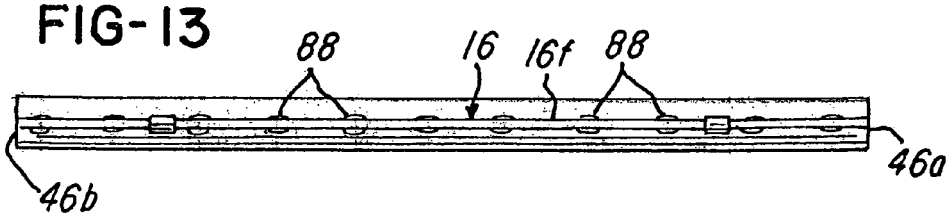
FIG. 13 is a top view of the embodiment shown FIG. 7.
Figure 9:
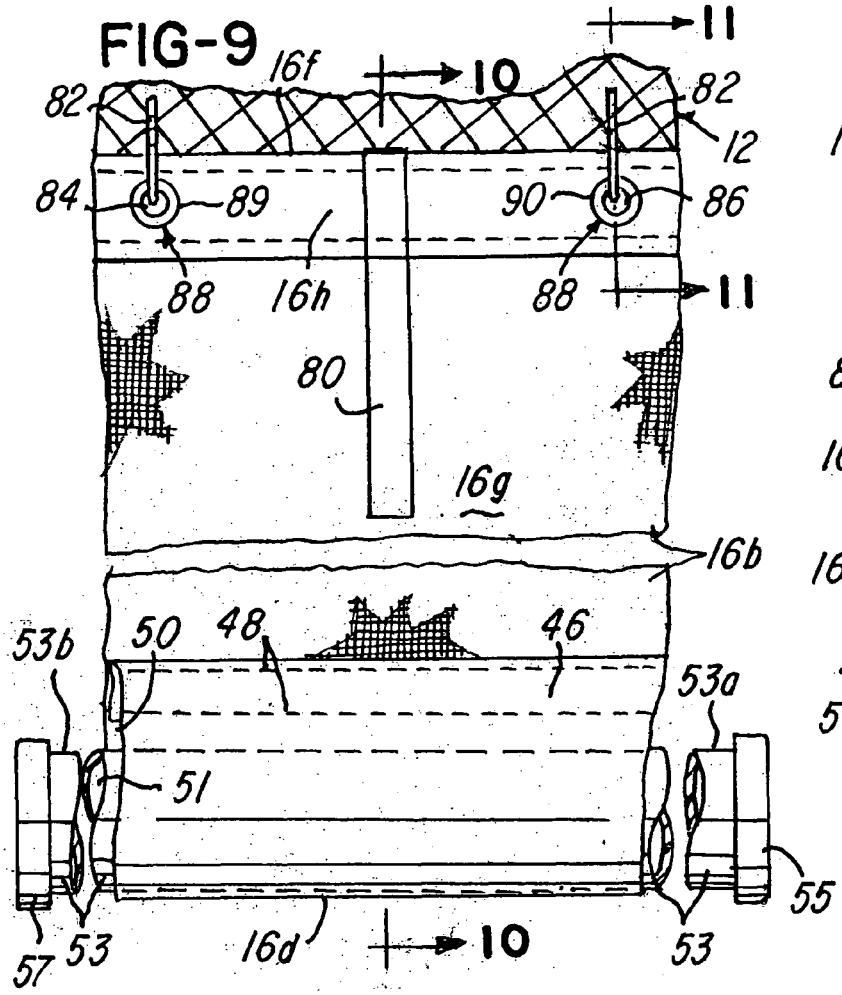
FIG. 9 is a fragmentary front view of said windscreen.
Figure 10:
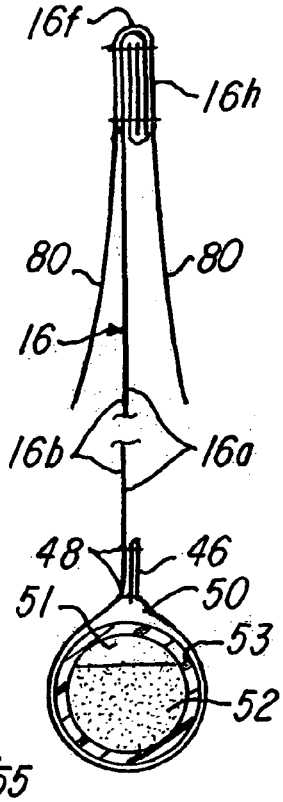
FIG. 10 is a vertical cross-section taken along line 10-10 of FIG. 9.
Figure 14:
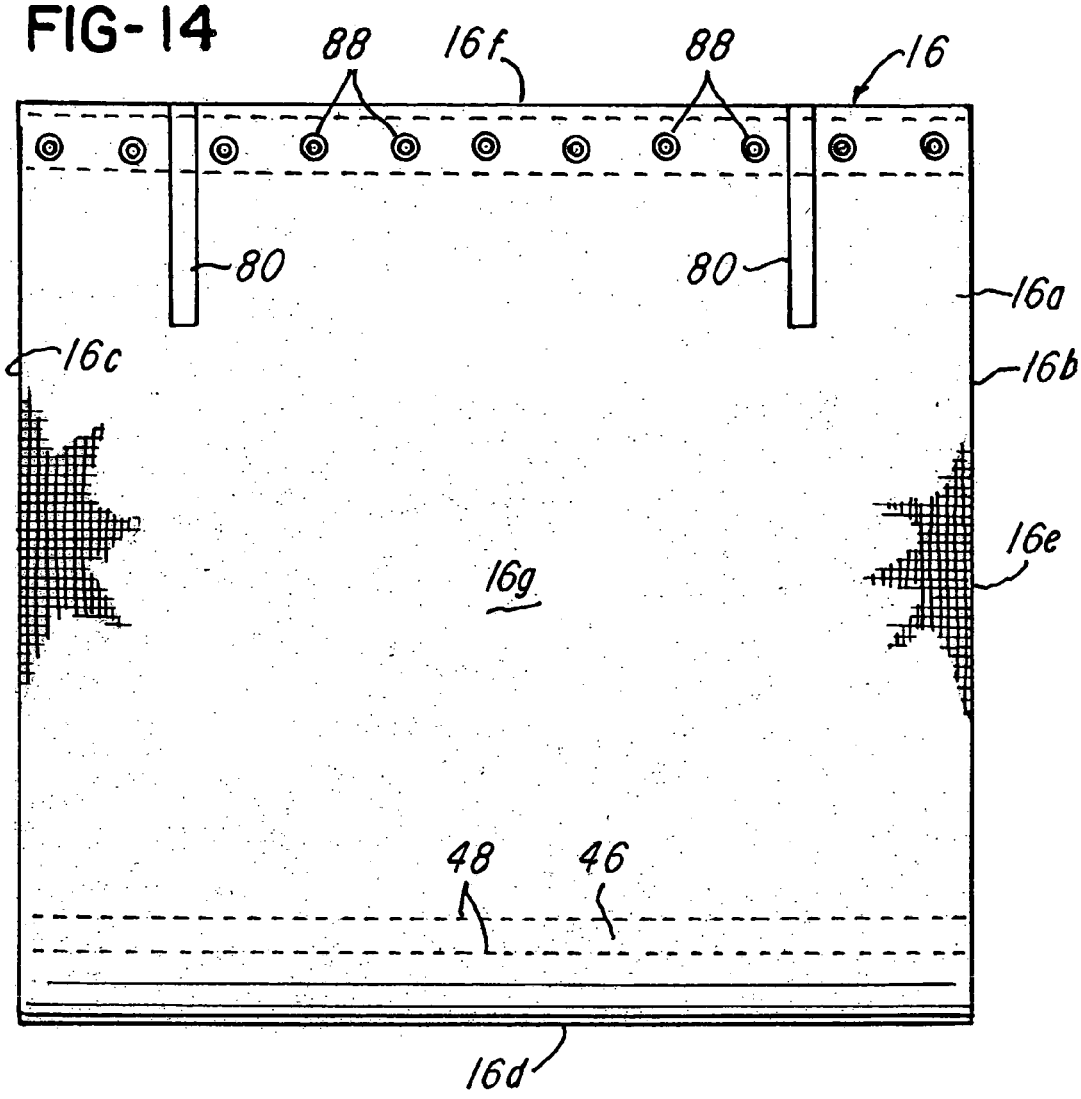
FIG. 14 is a rear view of the embodiment shown FIG. 7.
Figure 15:
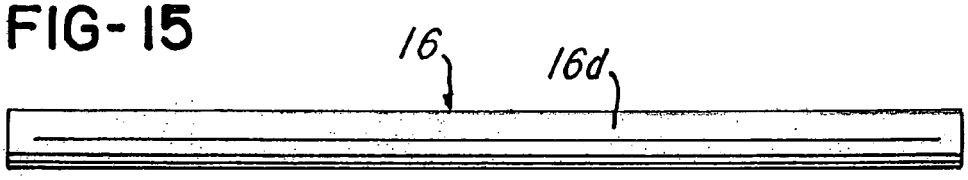
FIG. 15 is a bottom view of the embodiment shown FIG. 7.

As illustrated in FIGS. 7 and 8, the windscreen 16 comprises first side edge 16*c*, a bottom edge 16*d*, a second side edge 16*e* and a top edge 16*f* as shown. The windscreen 16 further comprises a hem 46 that is formed, as shown in FIGS. 10 and 14, by gathering or folding the windscreen 16 upon itself (FIG. 10) and providing one or more stitches 48 or other means for securing windscreen 16 to form the hem 46. Note that the hem 46 forms, provides or defines a pocket or receiving area 50 (FIGS. 9 and 10) for receiving ballast or weight 52 to facilitate providing stability and ballast to the windscreen 16 after it is mounted onto the fence 12. The ballast or weight 52 may be placed directly in the receiving area 50 and one or both ends 46*a* and 46*b* (FIG. 7) of hem 46 stitched (not shown) to seal the hem 46.

In other embodiments, a tube, pipe, rod, steel, wood member, or container 53 may be inserted into the receiving area 50. As shown in FIGS. 9 and 10, container 53 may comprise removable caps, lids or ends 55 and 57 that are press fit onto the ends 53*a* and 53*b*, respectively, of container 53. The container 53 itself may provide ballast or weight 52 and/or it may provide a receiving area 51 for receiving ballast or weight 52. Thus, it should be understood that the ballast or weight may be provided by the container 53 itself or any suitable means for providing weight or ballast, such as sand, metal, chain, pipe, or the like to the bottom 16*d* of windscreen 16. As mentioned earlier, the container 53 may define or provide a storage container or means that is adapted to receive a pre-selected amount of ballast material, such as the ballast material 52 in FIG. 10. In this regard, the amount of ballast material or weight 52 (FIG. 10) situated in areas 50 of hem 46 and/or 51 of container 53 may be changed so that resilience or resistance of the windscreen 16 to an oncoming wind force can be adjusted.

Thus, it should be understood that the ballast container 53 may integrally provide the ballast or weight material 52 in the area 50 or it may provide the sealed container 53 having the area 51 (FIG. 10) for receiving ballast or weight 52. The removable caps or lids 55 and 57 (FIG. 10) may be provided to seal the area 51 for sealing ballast container 53 so that when material ballast or weight 52 is received in the area 51 of ballast container 53, it does not escape. As mentioned earlier, however, it should be understood that no container 53 may be used if desired and the hem pocket or area 50 of hem 46 itself may directly receive ballast or weight 52, such as the sand, chain, without the use of the ballast container 53 as desired.

Figure 18:
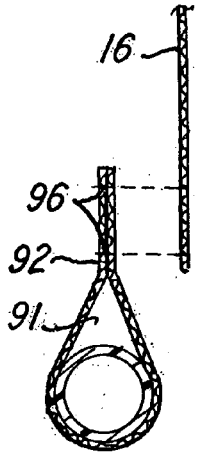
FIG. 18 is an illustration showing a separately attachable pocket into which a ballast or weight may be situated.
Figure 19:
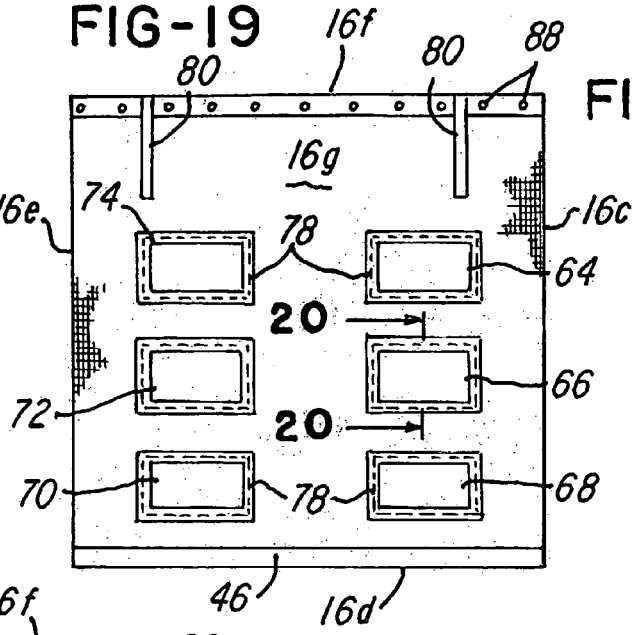
FIG. 19 is a front view of another embodiment.
Figure 20:
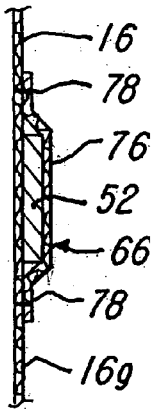
FIG. 20 is a sectional view taken along the line 20-20 in FIG. 19.
Figure 21:
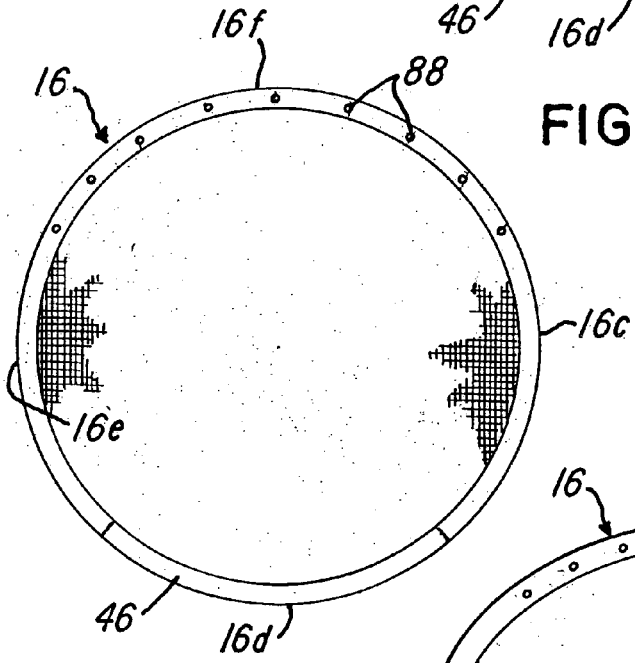
FIGS. 21-22 are views of other embodiments of the invention showing the windscreens having a configuration or shape other than rectangular.
Figure 22:
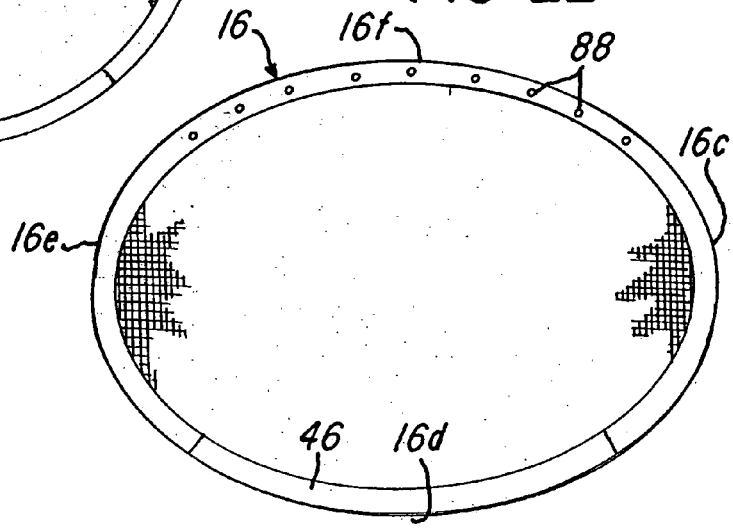
Figure 23:
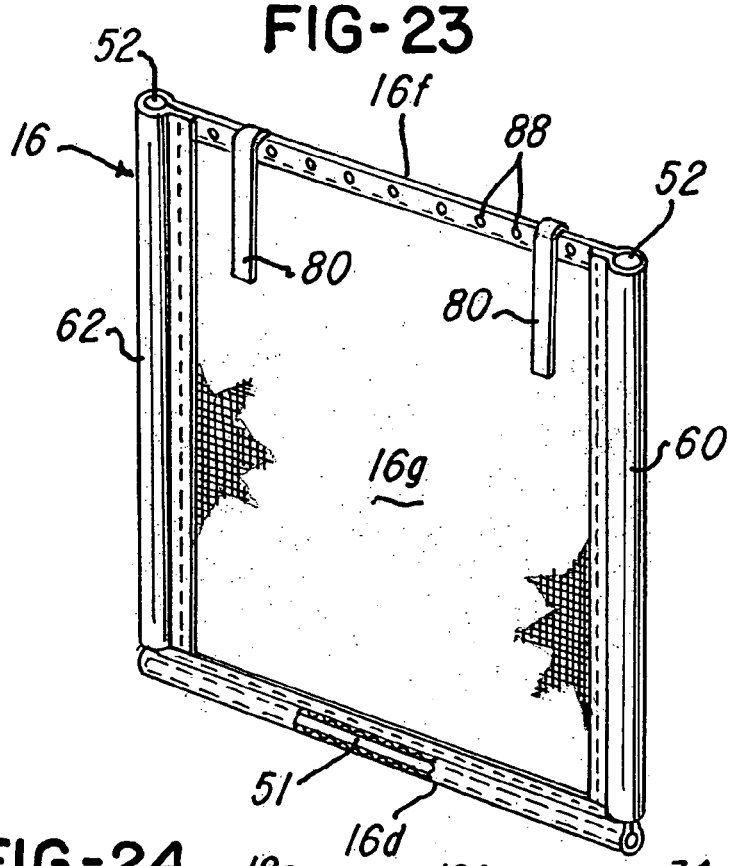
FIG. 23 is a perspective view of another embodiment of the invention illustrating a plurality of pockets and/or ballast on vertical sides of the windscreens.

For ease of illustration, features of the present discussion presumes the hem 46 has the container 53 in the receiving area 50, but as mentioned earlier, other means and methods for providing and/or storing the weight could be provided. As best illustrated in FIGS. 9, 10, 12, 13, and 14, notice that the ballast container 53 and ballast pocket 50 in hem 46 are situated at the bottom area or edge 16*d* of the windscreen 16. However, a plurality of pockets or hems could be provided. For example, FIG. 23 illustrates one or more vertical hems or pockets 60 and 62 for receiving the ballast or weight material 52. FIGS. 18 and 19 illustrate the interior area 16*g* between the edges 16*c*, 16*d*, 16*e* and 16*f* comprising a plurality of receiving areas or pockets 64, 66, 68, 70, 72 and 74 receiving ballast or weight, such as sand, chain, steel, wood or the like. Each pocket 64-74 is defined by a material, such as material 76 (FIG. 20), that is sewn to interior area 16*g* with a stitch 78 as shown.

Figure 4:
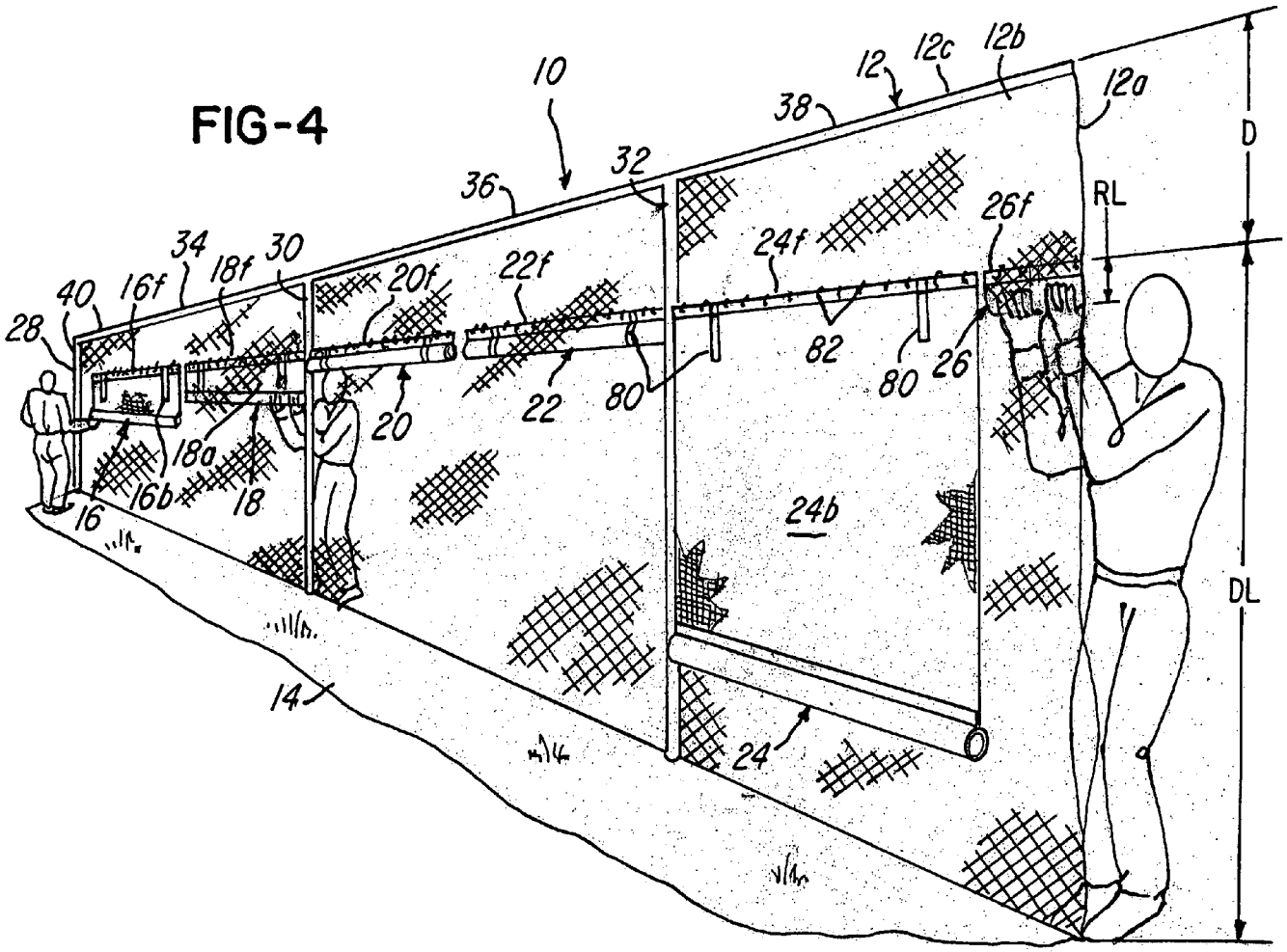
FIG. 4 is a perspective view illustrating the various plurality of windscreens at various stages of retraction.

In the illustration, a plurality of first fasteners 80 are provided and comprise tie straps as shown or may comprise other suitable means for securing the windscreen in a rolled-up or retracted position. For example, the at least one or plurality of first fasteners 80 may comprise Velcro®, snap fastener, bungee cord, rope or other means for retaining the windscreen in the rolled-up position, as illustrated in FIG. 4. Also, while the at least one or plurality of first fasteners 80 has been illustrated as being integrally formed or sewn into the windscreen 16 it should be appreciated that, although not shown, the windscreen 16 may comprise a non-integral fastener.

In one embodiment and as illustrated in FIG. 9, the at least one or plurality of first straps 80 may comprise elongated tie straps that are draped over the folded portion 16*h* and sewn directly thereto in order to form or provide a plurality of tie straps, such as straps 80, in opposed relation and adjacent to the first side 16*a* and the second side 16*b*, respectively, as illustrated FIG. 10. Note that the tie straps 80 (FIG. 10) provide a fastener or means for securing the windscreens 16-26 in the secured, retracted and locked position referred to earlier herein related to FIG. 4.

The at least one or plurality of first straps 80 enable the overall area or surface area, such as the area 16*g* (FIG. 7), of one or more of the windscreens 16-26 that is exposed directly to the wind to be decreased if desired. In this regard, note that the surface area of the windscreens 16-26 exposed to the wind can be reduced by retracting or rolling one or more of the windscreens 16-26 to a retracted or stored position, as illustrated by windscreens 20 and 22 in FIG. 4, which also facilitates reducing stress and forces on the fence 12. Note in FIG. 4 that the effective, wind-encountering area of the retracted windscreens 16-22 and 26 may be reduced by shortening the length from a fully deployed length DL (FIG. 4) to a retracted length RL in FIG. 4. The retraction may be accomplished, for example, by rolling the windscreen, such as windscreen 26, up and securing it in a stored or retracted position as shown in FIG. 4. Thus, it should be understood that the effective area of each windscreen 16-26 can be changed or even reduced, thereby reducing exposure to the wind W and stresses or forces on the fence 12.

As illustrated in FIGS. 9-12B, the system 10 also comprises at least one or a plurality of second fasteners 82 that are received in apertures defined by grommets 88. For example, note the grommets 89 and 90 (FIG. 9) define the apertures 84 and 86, respectively. To facilitate providing strength to the top edge 16*f*, the material or windscreen 16 may be folded or gathered upon itself to form a folded area 16*h*, as shown in FIG. 10, before the grommets are mounted or secured to the top edge 16*f* of windscreen 16. The at least one or a plurality of second fasteners 82 may include a split ring, wire-formed split ring, wire, hog wire, tie wrap, rope, hog ring, snap fastener, or other suitable means for securing the grommets or windscreen 16 to the fence 12, preferably, at its upper most or top edge 16*f*.

Figure 11:
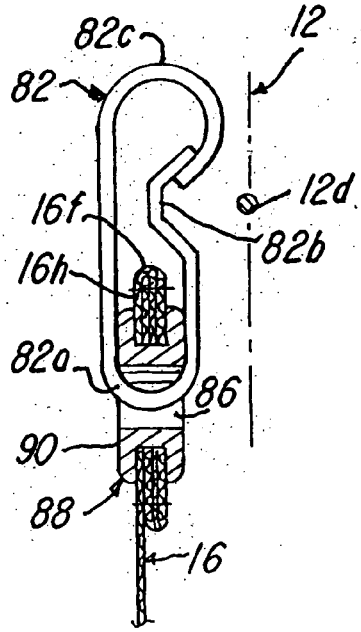
FIG. 11 is a view illustrating at least one fastener accordance with the embodiment of the invention.
Figure 12A:
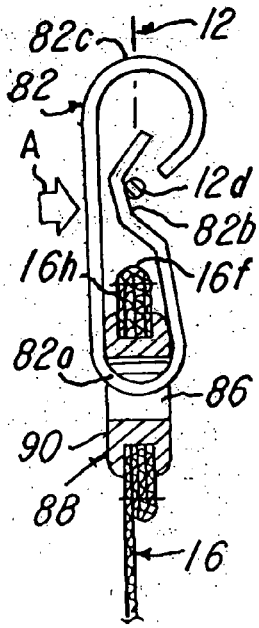
FIG. 12A-12B illustrate the process for fastening the at least one fastener onto a fence, thereby securing the windscreen.
Figure 12B:
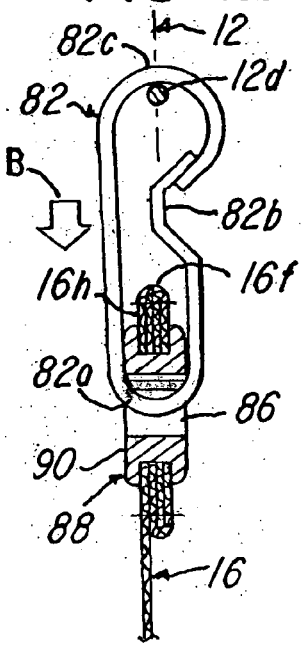

FIGS. 11-12B illustrate the at least one or a plurality of second fasteners 82 after it is situated in the grommet 86 associated with the aperture 84. The process of fastening the windscreen 16 onto the fence 12 will now be described.

As illustrated in FIG. 11 the second fastener 82 (a split ring in this example) is operatively received in the grommet 90 as shown such that a bottom curved or U-shaped portion 82*a* of the split ring 82 is received in and engages the grommet 90 as shown. A U-shaped portion 82*b* of the split ring 82 is situated in mounting relationship to at least one or a plurality of wires, such as wire 12*d*, that cooperate to form the chain-link fence 12. The second fastener 82 is moved in the direction of arrow A in FIG. 12A until the wire 12*d* engages and urges the U-shaped portion 82*b* of the at least one second fastener 82 from a closed position (FIG. 11) to an open position (FIG. 12A). After the split ring fastener 82 is opened as shown in FIG. 12A, the fastener 82 is moved relative to the wire 12*d* in the direction of arrow B in FIG. 12B until the wire 12*d* engages the top portion 82*c* of the at least one second fastener 82, whereupon the U-shaped portion returns to the closed position and the windscreen 16 becomes secured or fastened to the fence.

Advantageously, the fastening means or at least one second fastener 82 provides a system and means for fastening each of the grommets 88 to the fence 12. One feature of the embodiment being described is that the second fastener 82 can be fastened to the fence 12 using only one hand. This enables a single user, for example, to fasten the windscreens 16-26 to the fence 12 because the user can mount each second fastener 82 onto the fence 12 one at a time and without the need for one or more additional persons to separately hold the windscreen 16 in position during fastening.

Figure 24:
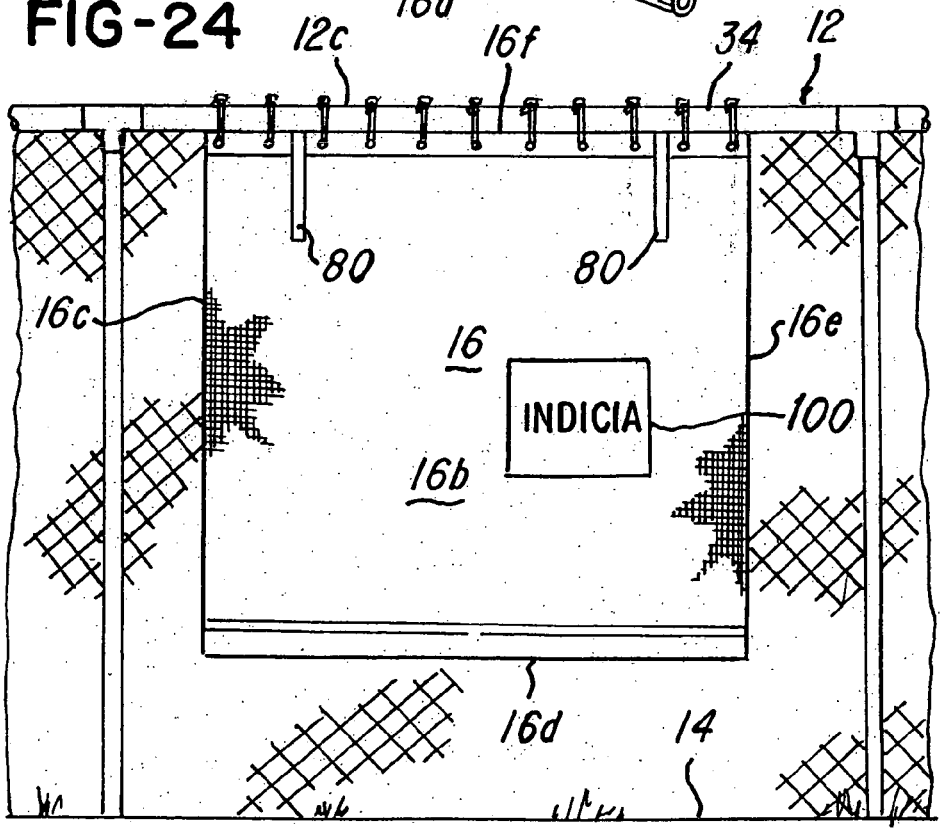
FIG. 24 is another view of a windscreen situated at a top edge of a fence, rather than drop below the top edge as illustrated in other embodiments.

As mentioned early herein, although one embodiment illustrates the use of the wire forms split ring illustrated FIGS. 11-12B, other means for fastening the windscreen 16 onto the fence 12 may be used, such as tie wraps, rope(s), wires, snap fasteners, hog wires, or the like. For example, FIG. 24 illustrates the windscreen 16 tied to the horizontal support 34 with individual plastic tie fasteners.

The system 10 and method provide means for protecting the area 14 from the wind W with at least one of the windscreens 16-26 and can facilitate reducing the size of the vertical posts or supports 28, 30 and 32 and horizontal supports 34, 36 and 38 used to construct the fence mentioned earlier. In this regard, note that stresses on the fence 12 are reduced because the windscreens 16-26 yield leeward and permit some or all air and wind to flow through the fence 12 after the wind reaches the predetermined velocity, rather than exert pressure against the fence 12. For example, a prior art chain link fence surrounding a tennis court (not shown) may comprise steel pipe vertical posts (not shown) having a gauge/diameter of 1.875 inches in diameter, 0.120 inch wall thickness or 11 gauge. The typical prior art windscreen would be attached to one side of the fence and would be able withstand a wind velocity up to a certain threshold. When used with a prior art windscreen, the fence 12 was capable of only withstanding winds up to about 45 mph before the wind force exerted so much pressure on the windscreen and fence that it caused the fence, the posts holding the fence or windscreen to fatigue and bend or become disformed or damaged. Thus, when the wind velocity exceeded the threshold, the wind force against the prior art fence and windscreen caused the vertical post, for example, to bend or become deformed. This caused damage to the fence, the windscreen and/or the supports for the fence. The non-repairable nature of the steel posts that were typically used with the chain link fence of the past made replacement necessary and expensive.

In contrast, a feature of the embodiment illustrated in FIGS. 1 and 2, for example, is that the one or more of the flexible sheet material windscreens 16-26 will yield downwind or leeward to a wind force in order to relieve stress on the fence 12, frame 40 and vertical posts or supports 28, 30 and 32. This facilitates allowing the fence 12 to withstand a higher wind velocity compared to prior art windscreens. This is particularly useful in areas where there can be high gusting winds because the system 10 will provide relief from high wind stresses that prior windscreens did not Returning to FIGS. 1-3, note that the windscreens may be arranged such that their sides or vertical edges, such as edges 16*c* and 18*c*, are adjacent or abut so there is no gap distance GD, which is the distance GD between adjacent edged of adjacent windscreens 16-26. As illustrated in FIG. 17, however, the windscreens 16-26 may be arranged such that their edges, such as edges 20*c* and 22*c* of windscreens 22 and 24, respectively, are separated to define the gap distance (GD) between windscreens 22 and 24.

Figure 3:
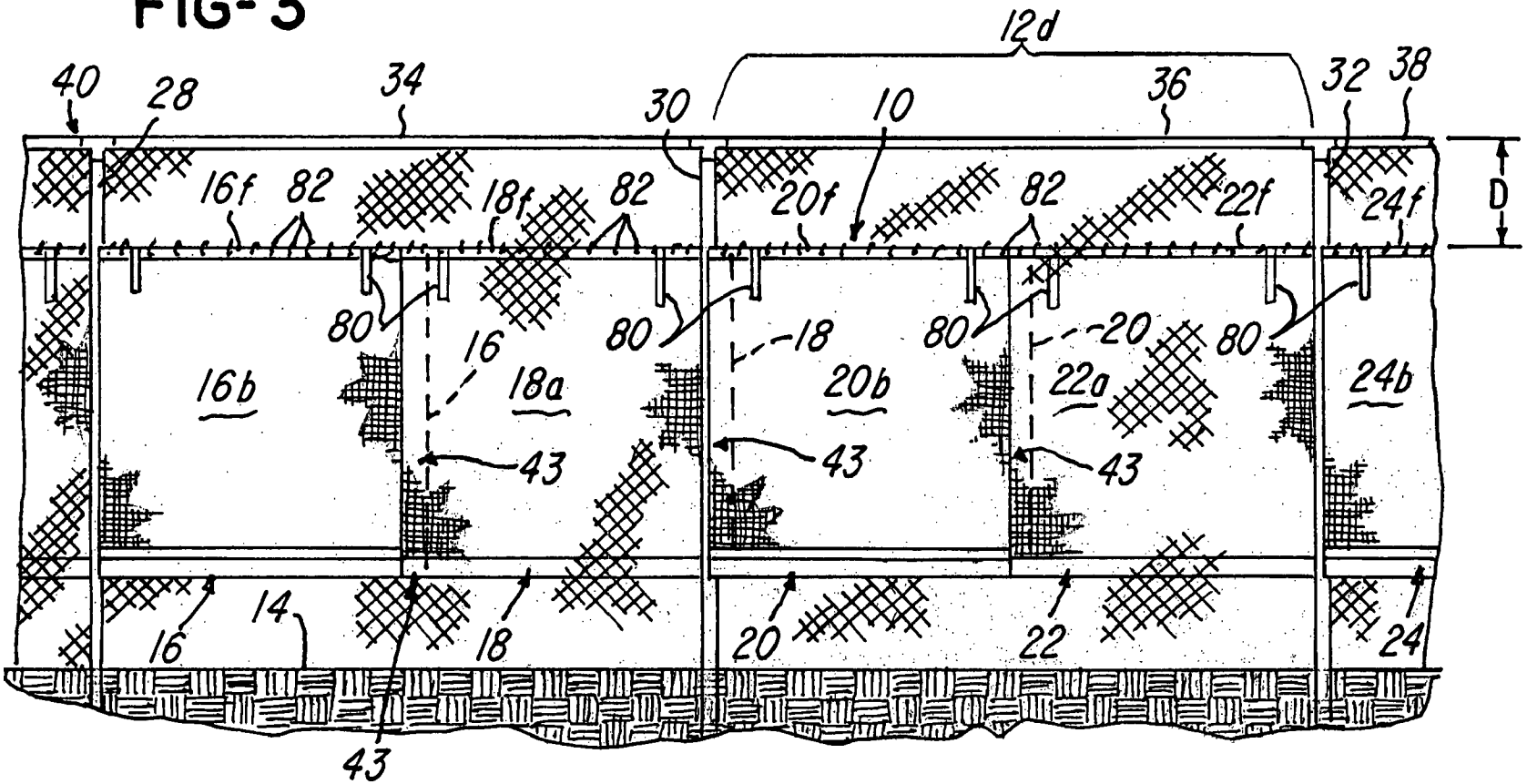
FIG. 3 is another perspective view showing a plurality of the windscreens overlapping a common area of the fence.

This feature of the embodiment shown in FIG. 3 is advantageous in that it permits system 10 to accommodate fences 12 of various sizes and reduces or eliminates the need for providing a windscreen of a custom size, specific or exact length or width dimension because the windscreens 16-26 may be overlapped (as shown by the overlapped areas 43 in FIG. 3) to accommodate fence 12 surface areas 42 (FIG. 2) of different dimensions.

In one embodiment, it is desirable that the windscreens 16-26 yield when the wind velocity equals or exceeds at least 25 mph, but the predetermined velocity at which the windscreens 16-26 yield may be selected in response to the environment and wind conditions in which the system 10 is used as described later herein.

A method for shielding the area 14 will now be described. In the illustration being shown, a determination is made of the typical wind speed or force that approaches the area 14 (FIG. 1). In response, the order in which the at least one or a plurality of windscreen 16-26 are to be place on the fence 12 is determined. The position of the windscreens 16-26 is also determined. After the order and position are determined, the plurality of fasteners 82 are used to fasten the plurality of grommets 88 and top edge, such as edge 16*f* of windscreen 16, of each windscreen to the fence 12 as illustrated in FIGS. 1-6, 9-12*b*, and 16-17. As mentioned earlier herein, each of the plurality of windscreens 16-26 comprise ballast or weight 52 of a predetermined amount. The windscreens 16-26 may be provided to the end users with the predetermined amount of weight 52 or it may be provided to the end user such that the end user can adjust or vary the amount of ballast or weight 52 in the area 50 or area 51 of ballast container 53. As mentioned earlier, if a ballast container 53 is used, one or more of the removable end caps 55 and 57 referred to earlier for sealing the ends of the container 52 after ballast or weight 52 (FIG. 10) has been inserted therein.

It is important to note that each of the windscreens 16-26 will have at least a first side, such as sides 16*a*, 18*a*, 20*a*, 22*a*, 24*a* and 26*a* (FIG. 1), situated adjacent to the fence 12 and a second side, such as sides 16*b*, 18*b*, 20*b*, 22*b*, 24*b* and 26*b*, situated opposite thereto, respectively. The second sides 16*b*, 18*b*, 20*b*, 22*b*, 24*b* and 26*b* face away from the fence 12. The predetermined weights or ballast 52 situated in the windscreens 16-26 are selected such that the second sides 16*b*, 18*b*, 20*b*, 22*b*, 24*b* and 26*b* of the windscreens 16-26 will yield downwind or leeward away from the fence 12 when wind engages the first sides 16*a*, 18*a*, 20*a*, 22*a*, 24*a* and 26*a* with a predetermined velocity. This is illustrated in FIGS. 5-6 relative to the windscreens 16 and 18. Note in FIG. 5 that the first side 16*a* of windscreen 16 is adjacent to the fence 12 and the second side 16*b* faces away from the fence 12 in the illustration being shown. Likewise, the windscreen 18 comprises the first side 18*a* situated adjacent to the fence 12 and the second side 18*b* that faces away from fence 12. When the wind W approaches from the side 12*a* of fence 12 (as viewed in FIG. 5) the wind engages the second side 18*b* of the windscreen 18 and forces the windscreen 18 and side 18*a* against the fence 12 as shown. Substantially simultaneously, the wind W engages the first side 16*a* of windscreen 16 and when the wind equals or exceeds the predetermined velocity, that windscreen 16 begins yielding downwind or leeward as shown, thereby facilitating, relieving or reducing the pressure or force against or on the fence 12.

Likewise, as wind W approaches from the left (as viewed in FIG. 6) in the example, the wind W engages the second side of 16*b* of windscreen 16 to force the side 16*a* of windscreen 16 against the second side 12*b* of fence 12. Substantially simultaneously, the wind W engages the first side 18*a* of the windscreen 18 and when the wind equals or exceeds the predetermined velocity, the windscreen 18 begins to yield in a downwind or leeward direction as shown in FIG. 6.

As illustrated in FIG. 5, note that an angle of incidence $\Theta_1$ relative to the wind W is generally about ninety degrees before wind W reaches the predetermined velocity and before the windscreens 16 and 18 yield. In the illustration, the wind is shown encountering the sides 16*a* and 18*a* at an angle of incidence $\Theta_1$ that is substantially perpendicular in the illustration to a plane P in which the fence lies. In the event the wind exceeds the predetermined velocity, such as 25 mph in one illustration, the windscreens 16-26 situated on the downward or leeward side of the fence 12 (side 12*b* in the illustration shown in FIG. 5) will yield as illustrated relative to windscreen 16 in FIG. 5. Note that the angle of incidence increases from $\Theta_1$ to $\Theta_2$, which facilitates reducing the force on fence 12 when compared to a system where the windscreens do not yield at all.

In the embodiment being described, the predetermined velocity may be at least 25 mph, but it could be higher or lower. This means that the windscreens 16-26 will remain substantially against the fence 12 at wind velocity less than 25 mph, thereby blocking or screening the area 14 (FIG. 1) from the wind W. When the wind W equals or exceeds the predetermined velocity, such as 25 mph in the illustration being described, then the one or more the windscreens 16-26 will yield downwind or leeward to the wind W in order to reduce stress and force against one or more of the windscreens 16-26 and the fence 12.

As mentioned earlier herein, the amount of weight or ballast 52 situated in each of the windscreens 16-26 will be provided or selected in response to a determination or estimation of the sustained predetermined velocity and wind direction, the material comprising the windscreen and other factors. Thus, when the predetermined velocity or threshold is selected to be greater than 50 mph in the illustration, a greater amount of ballast or weight 52 would be situated in the area 50 defined by hem 46 or in area 51 of container 53 if a container 53 is used. Where it is desired to have the windscreens 16-26 yield at a lower wind velocity, then a less amount of predetermined ballast or weight 52 would be selected. The variability of the ballast or weight 52 is particularly useful because different fences have different diameter or gauge steel posts or supports, such as supports 28-38. For example, it may be desired to use less ballast or weight on a fence frame that is not capable of resisting much wind force and to use more ballast or weight on a stronger fence frame that is capable of resisting more wind force. While the windscreens 16-26 may be provided with a standard or predetermined amount of weight or ballast 52, that ballast or weight may be adjusted in response to the strength of the fence, the typical wind conditions, or wind forces encountered by the fence 12 and the like, thereby enabling the system 10 to be adjustable to respond or yield to different wind velocities.

Thus, it should be understood that while at least 25 mph is referred to in one embodiment described herein as a desired velocity threshold, this threshold or predetermined velocity may be established higher or lower depending upon the environment and application in which the system 10 is being used.

Referring now to FIGS. 1-4 and 16-17, notice that the inventors have found that it may useful, but not mandatory, to mount or fasten the windscreens 16-26 on the fence 12 at the predetermined distance D from a top edge 12*c* of fence 12. In the illustration shown in FIG. 1 for example, the predetermined distance D may be six inches in the embodiment being described, but that distance D could be larger or smaller if desired. Note in FIG. 24 that the windscreen 16-26 may be mounted so there is zero distance D between top edge 16*f* and edge 16*d*. The distance D may also change depending on the overall height of the fence 12. By lowering the top edge, such as edge 16*f* on windscreen 16, to the predetermined distance D from the edge 12*c*, the force or moment arm on the fence 12 is reduced from the distance L2 (FIG. 2) to the distance L3. This reduction in the moment arm further facilitates reducing the force on the fence 12 relative to any windscreens that do not yield leeward, such as windscreen 18, 22, and 26 as shown in illustration. Thus another feature of the embodiment illustrated and described relative to FIGS. 1 and 2, is that the windscreens 16-26 may be dropped below the top edge 12*c* of the fence 12 in order to further facilitate reducing the force on the fence 12.

It should be understood that although the embodiments illustrated show each of the top edges 16*f*, 18*f*, 20*f*, 22*f*, 24*f* and 26*f* (FIG. 1) of the windscreens 16-26 being generally collinear or situated at substantially an equal distance from the top edge 12*d* of fence 12, it should be understood that each of the windscreens 16-26 may be situated at the same distance D or at different distances so that the distance D varies or is different for a plurality of the windscreens 16-26. Also, it should be understood the windscreens 16-26 may be situated so that their top edges, such as edge 40 of windscreen 16, are not collinear.

The system 10 further comprises the at least one or a plurality of first fasteners 80 that provide other means for reducing the exposed surface area of the windscreens 16-26 relative to the wind. Thus, the effective surface area exposed to an oncoming wind may be reduced for one or more of the windscreens 16-26 to further facilitate reducing overall force or moment applied that the fence 12 experiences when the wind engages it. Note that each of the windscreens 16-26 may be secured to the stored or rolled-up position (as illustrated by windscreen 20 in FIG. 4) and the effective area that each windscreen exposed to the wind may be either different or the same. In the illustration of FIG. 4, some of the windscreens 16-26 are rolled or stored to a fully deployed position while others, such as windscreens 16, 18, and 26, are illustrated in a less than fully retracted or rolled-up position. This is particularly useful when known high winds, such as a hurricane, are approaching the area 14 in which the user can retract or secure windscreens 16, 20 and 24 in the rolled-up or retracted position.

In the illustration being described, the windscreens 16, 18, and 26 are shown retracted at different positions. Thus, although not shown, the straps may be provided such that one or more of the windscreens 16-26 may be rolled up and secured to different lengths (FIG. 4).

As mentioned earlier herein, not only may the windscreens 16-26 be placed at different heights relative to each other and relative to the top edge 12*c* of fence 12, they may also be placed such that they overlap a common portion of the fence 12, as illustrated in FIG. 3. Also, the windscreens 16-26 may be situated directly adjacent each other as illustrated in FIGS. 1 and 2 or they may be situated such that adjacent edges do not meet or overlap or define the gap distance GD mentioned earlier and as illustrated in FIGS. 2 and 17. In this regard, notice that the edge 22*c* of windscreen 22 in FIG. 17 is situated the gap distance GD from the edge 20*c* of windscreen 20. In the embodiment being described, this gap distance GD may be a few inches or alternatively it could be many feet or meters.

In the embodiment being described, each of the plurality of windscreens 16-26 is made from a mesh material (or screened material, such as 12×18, vinyl coated polyester scrim and 1000 denier material, but it should be understood that other suitable mesh or windscreen materials may be used. For example, the material could be a solid polyvinyl material or any flexible, wind or weather resistant flexible sheet or film, such as Mylar® or the like. It should be understood that the material selected could be a mesh fabric that permits air to pass through or it could be a material or fabric that does not permit air to pass through. The type of material may vary depending upon such factors as the strength of the fence 12, the typical wind conditions, wind velocity, wind direction, area of the fence 12 covered, mounting height and the like. Moreover, each of these windscreens 16-26 may comprise indicia, such as advertising indicia 100 (FIG. 24) or other information signage if desired.

Also, each of the windscreens 16-26 are illustrated as being generally rectangular or square, but it should be understood they could comprise any predetermined configuration or shape, such as any polygonal shape, multi-sided shape, circular or elliptical shape or any combination thereof. For example, FIGS. 22A and 22B illustrate windscreen 16 comprising the circular or elongated shapes.

The illustrations shown in FIGS. 1-17 and 19-22 illustrate the ballast or weight provided in the hem 46. An alternate embodiment, illustrated in FIG. 18, shows a pocket, receiving pocket or area 91 provided by a separate material 92 that is affixed to a windscreen material, such as windscreen 16 (without the hem 46), with stitches 96. Although not shown, the separate windscreen may be non-permanently secured using a suitable detachable fastener (not shown) such as a snap fastener (not shown) or Velcro® fastener (not shown).

While the system and method herein described, and the form of apparatus for carrying this method into effect, constitute preferred embodiments of this invention, it is to be understood that the invention is not limited to this precise system and method and form of apparatus, and that changes may be made in either without departing from the scope of the inventions, which is defined in the appended claims.

What is claimed is:

1. A windscreen for mounting onto a fence, having a first fence side and an opposite fence side, said windscreen comprising:

a plurality of flexible sheet material panels mounted onto the fence; and a ballast material mounted on, received in or secured to each of said plurality of flexible sheet material panels for providing a preselected weight or ballast to the flexible sheet material panels, said ballast material selected to permit each of said flexible sheet material panels to yield to a non-vertical position in response to an oncoming wind when said oncoming wind exceeds a predetermined velocity to reduce or facilitate reducing stresses on the fence;

said plurality of flexible sheet material panels each comprising a first panel side situated adjacent the fence and a second panel side situated opposite said first panel side, said ballast being selected such that each said flexible sheet material panel yields leeward away from the fence when a wind of said predetermined velocity engages said first panel side of a flexible sheet material panel to reduce or facilitate reducing stresses on the fence, said plurality of flexible sheet material panels connected to the fence in one of the following arrangements:

a) all of said plurality of flexible sheet material panels are located on the first fence side of the fence;

b) all of said plurality of flexible sheet material panels are located on the opposite fence side of the fence;

c) each of the plurality of flexible sheet material panels are staggered with respect to the flexible sheet material panel immediately adjacent, such that the flexible sheet material panels alternate between connection to the first fence side of the fence and connection to the opposite fence side of the fence;

d) each of the plurality of flexible sheet material panels are connected to either the first fence side or the opposite fence side, without regard to the location of any other flexible sheet material panel;

wherein flexible sheet material panels are arranged on the fence so that the vertical side edges of adjacent panels abut so there is no gap between adjacent panels, or the panels can be arranged on the fence so that the vertical side edges of adjacent panels do not abut so there is a gap distance between adjacent panels.

2. The windscreen as recited in claim 1 wherein each of said plurality flexible sheet material panels comprises a bottom edge and a top edge, said ballast being located adjacent said bottom edge.

3. The windscreen as recited in claim 1 wherein said predetermined velocity is at least 25 mph.

4. The windscreen as recited in claim 1 wherein said windscreen comprises an edge, said windscreen further comprising:

at least one fastener adapted to fasten said edge at a predetermined location on the fence.

5. The windscreen as recited in claim 4 wherein said predetermined location is associated with a top of the fence.

6. The windscreen as recited in claim 4 wherein said predetermined location is a predetermined distance below a top of the fence.

7. The windscreen as recited in claim 6 wherein said predetermined distance is at least 6 inches.

8. The windscreen as recited in claim 4 wherein said at least one fastener comprises a tie wrap, rope, split ring, hog ring, snap fastener, wire-formed split ring, wire, or hog wire.

9. The windscreen as recited in claim 1 wherein each of said plurality flexible sheet material panels comprises at least one second fastener for fastening and retaining each of said plurality of flexible sheet material panels in a stored configuration.

10. The windscreen as recited in claim 9 wherein said at least one second fastener comprises at least one tie secured at a top edge of the flexible sheet material.

11. The windscreen as recited in claim 1 wherein each of said plurality of flexible sheet material panels comprises a fabric that permits air to pass therethrough.

12. The windscreen as recited in claim 1 wherein each of said flexible sheet material panels comprises a predetermined weight that provides said preselected amount of weight or ballast.

13. The windscreen as recited in claim 1 wherein each of said plurality of flexible sheet material panels comprises a fabric that does not permit air to pass therethrough.

14. The windscreen as recited in claim 1 wherein said plurality of flexible sheet material panels comprises a ballast pocket for receiving said preselected amount of weight or ballast.

15. The windscreen as recited in claim 14 wherein said ballast pocket comprises or receives a ballast container.

16. The windscreen as recited in claim 15 wherein said ballast container comprises or receives said preselected amount of ballast material.

17. The windscreen as recited in claim 15 wherein said ballast material is sand.

18. The windscreen as recited in claim 14 wherein said ballast pocket is located on a bottom edge of each of said plurality of flexible sheet material panels.

19. The windscreen as recited in claim 14 wherein said ballast pocket is located on at least one vertical edge of each of said plurality flexible sheet material panels.

20. The windscreen as recited in claim 14 wherein said ballast pocket is defined by providing a hem in each of said plurality of flexible sheet material panels.

21. The windscreen as recited in claim 20 wherein said hem is formed adjacent a bottom edge of each of said plurality of flexible sheet material panels.

22. The windscreen as recited in claim 1 wherein each of said plurality of flexible sheet material panels comprises weight located in a plurality of ballast areas located in an interior area of said flexible sheet material panel.

23. The windscreen as recited in claim 22 wherein said weight comprises sand, a chain or a pipe.

24. The windscreen as recited in claim 1 wherein each of said plurality of flexible sheet material panels comprises a predetermined shape.

25. The windscreen as recited in claim 24 wherein said predetermined shape said ballast is located intermediate a top edge and a bottom edge of each of said plurality of flexible sheet material panels.

26. The windscreen as recited in claim 1 wherein said ballast is located intermediate a top edge and a bottom edge of said flexible sheet material.

27. A method for reducing forces on said fence surrounding a fenced area using the windscreen as recited in claim 1.

28. The method as recited in claim 27 wherein said method further comprises the step of using the staggered configuration c) wherein each of said plurality of flexible sheet material panels are arranged on said first fence side and said opposite fence side with said gap having said gap distance existing between adjacent ones of said plurality of flexible sheet material panels.

29. The method as recited in claim 1 wherein said gap distance is greater than zero.

30. The method as recited in claim 1 wherein said gap distance is zero.

31. The method as recited in claim 1 wherein said method further comprises the step of:

overlapping an area of the fence with said plurality of flexible sheet material panels situated on opposite sides of the fence.

32. The method as recited in claim 1 wherein said method further comprises the step of:

overlapping an area of the fence with said plurality of flexible sheet material panels situated on a same side of the fence.

33. The method as recited in claim 1 wherein said method further comprises the step of:

arranging said plurality of flexible sheet material panels on a same side of the fence.

34. The method as recited in claim 1 wherein said method further comprising the step of:

arranging said plurality of flexible sheet material panels on the said first fence side and said opposite fence side such that at least fifty percent of each of said first fence side and said opposite fence side of said fence are covered.

35. The method as recited in claim 1 wherein all of said first one of said plurality of flexible sheet material panels yields when said predetermined velocity exceeds at least 25 mph.

36. The method as recited in claim 27 wherein said method further comprising the step of:

situating said plurality of flexible sheet material panels in a predetermined order on the fence.

37. The method as recited in claim 36 wherein said predetermined order is such that every other one of said plurality of flexible sheet materials are situated on opposite sides of the fence.

38. The method as recited in claim 36 wherein at least two of said plurality of flexible sheet material panels are situated on the same side of said fence.

39. The method as recited in claim 36 wherein said plurality of flexible sheet material panels are arranged in equal numbers on said first fence side and said opposite fence side of the fence.

40. The method as recited in claim 36 wherein said plurality of flexible sheet material panels are arranged in unequal numbers on said first fence side and said opposite fence side of the fence.

41. The method as recited in claim 36 wherein said method comprises the step of:

providing a first flexible sheet material panel, a second flexible sheet material panel, a third flexible sheet material panel and a fourth flexible sheet material panel;

situating said first, second, third and fourth flexible sheet material panel in said predetermined order on the fence.

42. The method as recited in claim 41 wherein said predetermined order is such that said first, second, third and fourth flexible sheet material panel are arranged on the first fence side, opposite fence side, first fence side, opposite fence side, respectively.

43. The method as recited in claim 41 wherein said at least two of said first, second, third and fourth flexible sheet material panel are situated on the same side.

44. The method as recited in claim 41 wherein said first, second, third and fourth flexible sheet material panel are arranged in equal numbers on said first fence side and said opposite fence side of the fence.

45. The method as recited in claim 41 wherein said first, second, third and fourth flexible sheet material panel are arranged in unequal numbers on said first fence side and said opposite fence side of the fence.

46. The method as recited in claim 27 wherein each of said plurality of flexible sheet material panels comprises at least one edge, said method further comprising the step of:

fastening said at least one edge to a predetermined location on the fence.

47. The method as recited in claim 26 wherein said at least one edge is a top edge of each of said plurality of flexible sheet material panels.

48. The method as recited in claim 46 wherein said predetermined location is associated with a top of the fence.

49. The method as recited in claim 48 wherein an intermediate flexible sheet material panel is situated between said top of said fence and a top edge of at least one of said first or second windscreens.

50. The method as recited in claim 46 wherein said predetermined location is below a top of the fence by a predetermined distance.

51. The method as recited in claim 50 wherein said predetermined distance is at least 6 inches.

52. The method as recited in claim 27 wherein each of said plurality of flexible sheet material panels comprises at least one edge, said method further comprising the step of:

fastening said at least one edge to a predetermined location on the fence using at least one fastener.

53. The method as recited in claim 52 wherein said at least one fastener comprises a tie wrap, rope, split ring, hog ring, snap fastener, wire-formed split ring, wire, or hog wire.

54. The method as recited in claim 27 wherein said method further comprises the step of:

deploying said at least one of said plurality of flexible sheet material panels in a less than 100 percent deployed position.

55. The method as recited in claim 54 wherein said method further comprises the step of:

retaining each of said plurality of flexible sheet material panels in said less than 100 percent deployed position using at least one second fastener.

56. The method as recited in claim 55 wherein said at least one second fastener is a tie.

57. The method as recited in claim 27 wherein each of said plurality of flexible sheet material panels comprises a fabric that permits a predetermined amount of wind to pass therethrough.

58. The method as recited in claim 27 wherein each of said plurality of flexible sheet material panels comprises an open weave that allows the passage of wind therethrough.

59. The method as recited in claim 27 wherein said method further comprises the steps of:

providing a fixed windscreen as one of said plurality of flexible sheet material panels; and affixing said fixed windscreen to said fence such that it does not yield to said wind.

60. The method as recited in claim 27 wherein said method further comprises the step of:

providing said plurality of flexible sheet material panels that are generally the same size.

61. The method as recited in claim 27 wherein said method further comprises the step of:

providing said plurality of flexible sheet material panels that are generally the same shape.

62. The method as recited in claim 27 wherein said method further comprises the step of:

providing each of said plurality flexible sheet material panels to comprise at least one ballast pocket adapted to receive said ballast material.

63. The method as recited in claim 62 wherein said method comprises the step of:

situating a ballast unit in said at least one ballast pocket.

64. The method as recited in claim 63 wherein said ballast unit is a container adapted to receive said ballast material.

65. The method as recited in claim 64 wherein said ballast material is sand, a chain or pipe.

66. The method as recited in claim 62 wherein said method comprises the step of:

providing a hem along one edge of each of said plurality of flexible sheet material panels, said hem being capable of receiving a ballast unit.

67. The method as recited in claim 66 wherein said ballast unit is a container adapted to receive said ballast material, said material further comprising the step of:

filling the container with said ballast material.

68. The method as recited in claim 66 wherein each of said plurality of flexible sheet material panels comprises a top edge and a bottom edge; said method further comprising the step of:

forming said hem along said bottom edge.

69. The method as recited in claim 62 wherein said method comprises the step of:

providing a hem along a plurality of vertical edges of each of said plurality of flexible sheet material panels.

70. The method as recited in claim 27 wherein said method comprises the step of:

situating weight in at least one interior area of at least one of said plurality of flexible sheet material panels to provide ballast thereto.

71. The method as recited in claim 27 wherein said method comprises the step of:

situating weights at a plurality of locations on at least one of said plurality flexible sheet material panels.

72. The method as recited in claim 27 wherein said method further comprises the step of:

situating said plurality of flexible sheet material panels on said fence to provide a continuous windscreen.

73. The method as recited in claim 27 wherein said method comprises the step of:

providing a plurality of flexible sheet material panels each of which define a predetermined shape.

74. The method as recited in claim 73 wherein said predetermined shape is polygonal, multi-sided, circular or elliptical.

75. The method as recited in claim 27 wherein said method further comprises the step of:

situating an unequal number of said plurality of flexible sheet material panels on said first fence side of the fence and an unequal number of said plurality of flexible sheet material panels on said opposite side of the fence.

76. The method as recited in claim 27 wherein said method further comprises the step of:

situating an equal number of said plurality of flexible sheet material panels on said first fence side and said opposite fence side.

77. The method as recited in claim 27 wherein said method further comprises the step of:

providing a plurality of flexible sheet material panels comprising generally the same dimensions.

78. The method as recited in claim 27 wherein said method further comprises the step of:

providing a plurality of flexible sheet material panels comprising generally different dimensions.

79. The method as recited in claim 27 wherein said method further comprises the step of:

providing a plurality of flexible sheet material panels comprising generally different shapes.

80. The method as recited in claim 27 wherein said method further comprises the step of:

providing a plurality of flexible sheet material panels, each of which are rectangular or square.

81. The method as recited in claim 27 wherein said method further comprises the step of:

providing a plurality of flexible sheet material panels, each of which are circular of elliptical.

82. The method as recited in claim 27 wherein said method further comprises the steps of:

providing each of said plurality of flexible sheet material panels with a plurality of grommets along an edge thereof;

situating a fastener through each of said plurality of grommets;

engaging said fastener against a link in said fence to open the fastener such that after the link is received in the fastener, said fastener closes to fasten the windscreen to the fence.

83. The method as recited in claim 82 wherein said fastener is a wire-formed split ring.

84. A method for screening an area from wind using the windscreen as recited in claim 1.

85. The method as recited in claim 84 wherein said predetermined velocity is on the order of at least 25 mph.

86. The method as recited in claim 84 wherein said method further comprises the steps of:

fastening said windscreen on said first fence side of the fence and fastening a second windscreen on said opposite fence side of the fence;

situating a predetermined amount of ballast in each of said plurality of flexible sheet material panels such that a leeward one of said plurality of flexible sheet material panels moves away from the fence to facilitate reducing a wind force on the fence.

87. The method as recited in claim 84 wherein the fence comprises a first side and a second side, said method further comprising the step of:

fastening a plurality of windscreens on the said first fence side and said opposite fence side such that at least fifty percent of each of said first fence side and said opposite fence sides of said fence are covered.

88. The method as recited in claim 84 wherein said predetermined amount of air to pass is at least 25 mph.

89. The method as recited in claim 85 wherein said method further comprises the step of:

determining a general amount of force the fence can withstand;

applying a predetermined amount of ballast to each of said plurality of windscreens in response to said determining step.

90. The method as recited in claim 89 wherein said method further comprises the step of:

making said windscreen from a material that defines not only the windscreen, but said predetermined amount of ballast as well.

91. The method as recited in claim 84 wherein said method further comprises the steps of:

providing a fixed windscreen in addition to said windscreen; and affixing said fixed windscreen to said fence such that its movement in a windward direction is restricted by the fence to which it is attached.

92. The method as recited in claim 84 wherein said method further comprises the step of:

fastening a plurality of flexible sheet material panels to said fence.

93. The method as recited in claim 92 wherein said method further comprises the step of:

fastening an unequal number of said plurality of flexible sheet material panels on said first fence side of the fence and an unequal number of said plurality of flexible sheet material panels on said opposite fence side of the fence.

94. The method as recited in claim 92 wherein said method further comprises the step of:

fastening an equal number of said plurality of flexible sheet material panels on said first fence side and said opposite fence side.

* * * * *

UNITED STATES PATENT AND TRADEMARK OFFICE

CERTIFICATE OF CORRECTION

PATENT NO. : 7,841,378 B2
APPLICATION NO. : 11/291754
DATED : November 30, 2010
INVENTOR(S) : William W. Henning It is certified that error appears in the above-identified patent and that said Letters Patent is hereby corrected as shown below:

On the Title Page in (57), Line 4, after facilitate, please delete "or".

In Column 3, Line 39, after shown, please insert -- in --.

In Column 3, Line 40, after shown, please insert -- in --.

In Column 3, Line 41, after shown, please insert -- in --.

In Column 3, Line 44, after shown, please insert -- in --.

In Column 7, Line 2, after illustrated, please insert -- in --.

In Column 7, Line 32, after grommets, please insert -- 89 and 90 --.

In Column 7, Line 40, please delete "86" and insert -- 90 -- therefor.

In Column 7, Line 41, please delete "84" and insert -- 86 -- therefor.

In Column 8, Line 25, before withstand, please insert -- to --.

In Column 8, Line 48, after not, please insert -- . --.

In Column 9, Line 9, please delete "place" and insert -- placed -- therefor.

In Column 9, Line 24, after container, please delete "52" and insert -- 53 -- therefor.

In Column 10, Line 16, after more, please delete "the".

In Column 11, Line 9, please delete "12d" and insert -- 12c -- therefor.

In Column 11, Line 14, please delete "40" and insert -- 16f -- therefor.

In Column 14, Line 18, after of, please insert -- each of said plurality of --.

In Column 14, Line 19, please delete "said".

In Column 14, Line 19, after material, please insert -- panels --.

In Column 17, Line 41, after circular, please delete "of" and insert -- or -- therefor.

In Column 18, Line 56, after claim 94, please add claim 83, which was left out of the printing of the patent as new claim 95: -- 95. The windscreen as recited in claim 24 wherein said predetermined shape is polygonal, multi-sided, circular or elliptical. --.

Signed and Sealed this
Eighth Day of January, 2013

David J. Kappos

David J. Kappos
*Director of the United States Patent and Trademark Office*